US005730357A

United States Patent [19]

Besenschek et al.

[11] Patent Number: 5,730,357

[45] Date of Patent: Mar. 24, 1998

[54] RAILROAD TIE PAD

[75] Inventors: Viktor Besenschek, Willowdale; Robert L. Hagerman, Aurora, both of Canada

[73] Assignee: Airboss of America Corp., South Haven, Mich.

[21] Appl. No.: 725,432

[22] Filed: Oct. 3, 1996

[51] Int. Cl.[6] ..... E01B 9/62

[52] U.S. Cl. ..... 238/283

[58] Field of Search ..... 238/283

[56] References Cited

U.S. PATENT DOCUMENTS

| | | | |
|---|---|---|---|
| 3,974,312 | 8/1976 | Stevens et al. | 428/91 |
| 4,254,908 | 3/1981 | Matsubara | 238/283 |
| 4,317,270 | 3/1982 | Watanabe et al. | 29/447 |
| 5,261,599 | 11/1993 | Brown | 238/283 |

FOREIGN PATENT DOCUMENTS

| | | | |
|---|---|---|---|
| 153407 | 12/1979 | Japan | 238/283 |
| 1275801 | 11/1989 | Japan | 238/283 |
| 2121461 | 12/1983 | United Kingdom | 238/283 |

*Primary Examiner*—S. Joseph Morano
*Attorney, Agent, or Firm*—Rader, Fishman, Grauer & McGarry

[57] ABSTRACT

A railroad tie pad comprises a hard polymer frame which defines a central cavity. An elastomeric insert fills the cavity and is secured to the frame. One side of the frame is wider than an opposing side.

17 Claims, 2 Drawing Sheets

RAILROAD TIE PAD

BACKGROUND OF THE INVENTION

1. Field of the Invention

This invention relates to railroad track construction and, more particularly, to an improvement in tie pads adapted to support a rail on a railroad tie.

2. Description of Related Art

The increased use of prestressed concrete railroad ties has increased the problem of flexural cracking at the rail seat area of the tie due to high-impact loads caused by the movement of trains over the rails. Prolonged imposition of such loads on the tie, if not suitably controlled, can result in propagation of the tracks, which eventually result in structural failure of the tie and/or loosening of the fastening system utilized to secure the rails to the tie. In addition, the loads can cause degredation of the road bed. The severe impact loads imposed on the rail and tie are usually derived from wheel tread defects, such as flats and spalls, eccentricities of the wheel due to wear, and rail anomalies, such as engine burns, corrugations, spalls, shelling, joints, chips and the like.

A solution to the impact loading problem has been to mount an elastomeric pad between the tie and the rail in an attempt to dampen impact loads and vibrational energy resulting from the passage of railroad vehicles over the rail. In addition, the pad functions as a bearing pad to accommodate imperfections in the fit between the steel rail and the concrete rail seat of the tie, and also aids in controlling abrasion of the tie. The pad can be replaced before the concrete rail seat is damaged.

Early conventional tie pads were usually composed of either polyethylene, wood, or corded rubber, while later pads were composed of either ethylene vinyl acetate (EVA), nylon, rubber-cork compounds, or neoprene rubber. The pads were sometimes grooved to provide a shape factor and accommodate migration of moisture. These prior art pads proved unsatisfactory because the rubber in neoprene pads tended to squeeze out from under the rail and often migrated from the rail seat area under high loads. The polyethylene or EVA pads tended to exhibit a somewhat better ability to stay in position and last longer than the earlier test pads. However, although conventional pads of the type listed have shown some improvement in the attenuation of impact loads and vibrational energy, they have not fully solved the above-discussed problems. Moreover, inadequately designed elastomeric pads have introduced a problem with moisture, especially in northern climes. Where a pad inadequately seals its surface adjacent the concrete rail seat area, moisture can be introduced, and the presence of moisture, especially with alternate freezing and thawing, introduces damaging stresses to the rail seat area.

U.S. Pat. No. 4,648,554, issued Mar. 10, 1989, discloses a railroad tie pad comprising a single layer of elastomeric material having dimples disposed on the upper and lower surfaces of the pad in offset relationship. During axial loading of the pad, the elastomer flattens and expands into the dimpled portions whereby the vertical compressive forces are directed substantially uniformly, radially, and tangentially throughout the pad. However, a railroad tie pad comprising a single sheet of elastomer has been shown to have a relatively short life span because of the shear forces applied to the surface of the pad by the rail.

The prior art also discloses an attempt to overcome the shear forces applied to the pad by the rail in a "sandwich" construction wherein a layer of urethane is bonded to one side of a steel plate and an elastomer is bonded to the opposite side of the steel plate. Such construction, however, has been shown to be prohibitively costly, and has also proven unsatisfactory due to the effects of moisture upon the steel. The problems of durability, satisfactory attenuation of loads and vibration, and moisture remain.

SUMMARY OF THE INVENTION

The foregoing problems are all addressed by the present invention of an improved railroad tie pad. According to the invention, a railroad tie pad comprises a hard, non-metallic polymer frame surrounding a central cavity. An elastomeric insert, slightly thicker than the frame, is secured to the frame and fills the central cavity. However, the width of the elastomeric insert is less than the width of the base portion of the rail which is adapted to rest upon the railroad tie pad. Thus, the outboard edges of the base of a rail will rest upon the hard polymer frame while the flexible elastomeric insert will seal the central cavity against the incursion of moisture into the rail seat area.

Preferably, the non-metallic polymer will be polyurethane or urethane, and the elastomeric insert will be either natural rubber or a blend of natural rubber and SBR. In one aspect of the invention, the elastomeric insert is bonded, either adhesively or chemically, to the frame, and in another aspect of the invention, the elastomeric insert is mechanically secured to the frame. In the latter aspect, the elastomeric insert will have tabs, and the frame will have recesses adapted to receive the tabs, or vice versa.

Typically, the frame will have a pair of opposed sides which generally parallel the base edges of a corresponding rail. One of those opposed sides of the frame will be wider than the other, and preferably, the outboard edge of the rail will bear against the wider side of the frame.

BRIEF DESCRIPTION OF THE DRAWINGS

The invention will now be described with reference to the drawings, in which.

DESCRIPTION OF THE PREFERRED EMBODIMENTS

Figure 1:
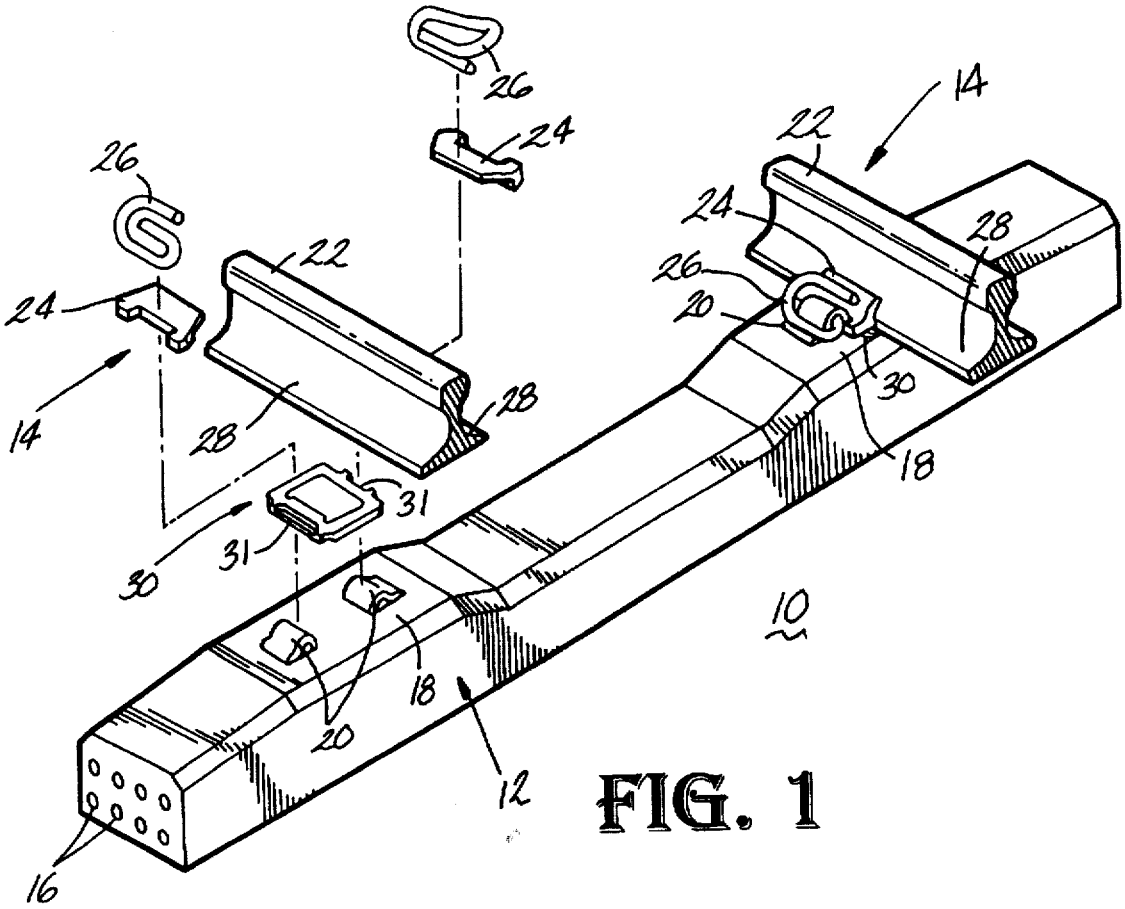
FIG. 1 is a perspective view illustrating the environment for the railroad tie pad according to the invention.

Referring now to the drawings, and to FIG. 1 in particular, there is illustrated an environment in which the railroad tie pad of the present invention will function. The environment comprises a railroad tie assembly 10 which includes a railroad tie 12 and a rail mounting system 14. The railroad tie 12 would typically be formed of concrete reinforced by steel rods 16, and having a pair of rail seat areas 18, one near each end of the tie. A pair of retainers 20 extend above each rail seat area. The rail mounting system 14 secures a pair of rails 22 to each tie 12, each rail extending in a normal direction relative to the tie and being supported on the rail seat area 18 with insulators 24, clips 26, in conventional manner, and a tie pad 30 according to the invention. The tie pad has notches 31 which permit it to nest between the retainers 20 on the rail seat area 18.

The rail 22 rests on the tie pad 30, and insulators 24 are placed on both sides of the rail 22 between the rail and the respective retainers 20, preferably resting on the tie pad 30. The dips 26 are securely fastened into the retainers 20, and abut the insulators 24, thereby urging the insulators to bear against a lower flange 28 of each rail 22. It will be apparent, by mounting the rail 22 to the tie 12 in this manner, that the rail is restrained from lateral movement, i.e., in a direction parallel to the longitudinal axis of the tie. On the other hand, some limited movement of the rail 22 is permitted longitudinally, along the longitudinal axis of the rail, normal to the tie. Such longitudinal movement of the rail is important, for example, on a grade. It is lateral forces acting on the rail, of course, that place increased stresses on the railroad tie pad, which is restrained from lateral movement by the retainers 20.

Figure 2:
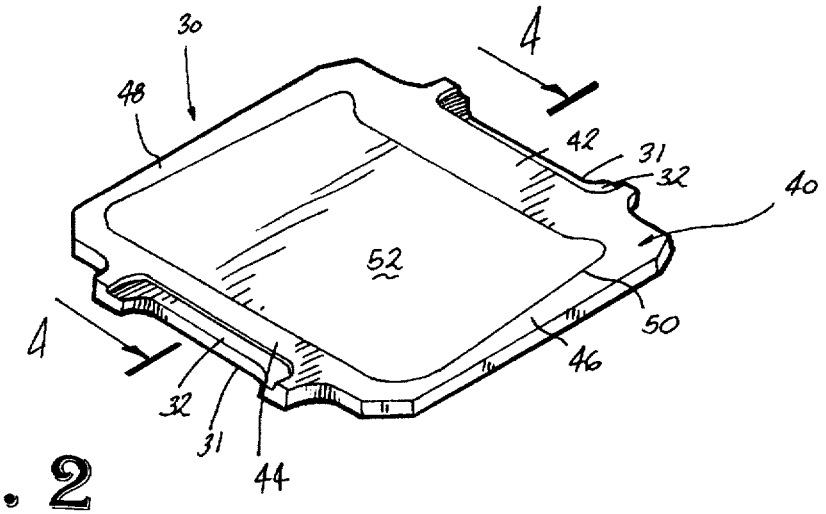
FIG. 2 is a perspective view of a railroad tie pad according to the invention.
Figure 3:
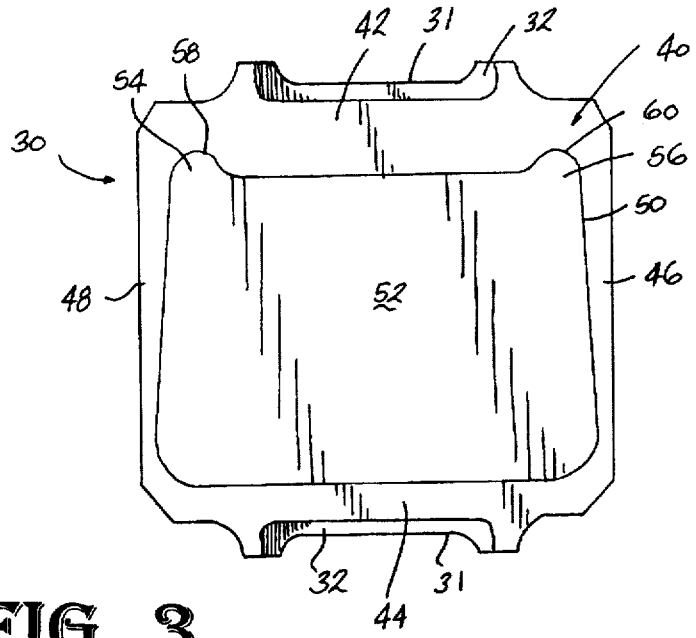
FIG. 3 is a plan view of the railroad tie pad of FIG. 2.

Turning now also to FIGS. 2 and 3, it will be seen that each notch 31 in the pad 30 will be shaped according to the specific combination of retainer 20, insulator 24, and clip 26 used to secure the rail. In the embodiment shown, the pad 30 has a recessed area 32 adjacent each notch which is adapted to receive and retain the lower edge of an insulator 24.

The pad 30 comprises generally a hard non-metallic polymer frame 40 comprising two pairs of opposed sides 42, 44, 46, 48 molded as a unit. The polymer would preferably be polyurethane or urethane. The first pair of opposed sides 42, 44 incorporate the notches 31, and the second pair of opposed sides 46, 48 extend between the first pair to complete the frame 40. One of the parallel sides containing a notch is designated an outboard side 42, and the opposing side of the pair is designated an inboard side 44. The outboard side 42 is wider than the inboard side 44.

The four sides of the frame define a central cavity 50 in which is received an elastomeric insert 52. The elastomeric insert 52 is preferably natural rubber or a blend of natural rubber and SBR. Its durometer is significantly less than the durometer of the non-metallic polymer, and it is sized and shaped to completely fill the central cavity 50. A typical durometer for the insert is in the range of 80–85, and the insert will typically be about 0.5 mm thicker than the frame. Of course, if a softer insert is provided, then its thickness will be proportionately greater than the thickness of the frame. The width of the central cavity extending from the outboard side 42 of the frame to the inboard side 44 of the frame, and thus the width of the elastomeric insert, is less than the width of a supporting flange 28 of a conventional rail.

The elastomeric insert 52 is inseparably bonded to the frame by the use of an adhesive, an insert mold bonding process, or by mechanical securement. In the embodiment illustrated in FIGS. 2 and 3, the elastomeric insert 52 has two tabs 54, 56 at opposite edges of the insert adjacent to the outboard side 42 of the frame, which are received in corresponding recesses 58, 60 in the frame. Of course, mechanical securement is obtained equally well with corresponding tabs in the frame and recesses in the insert.

Figure 4:
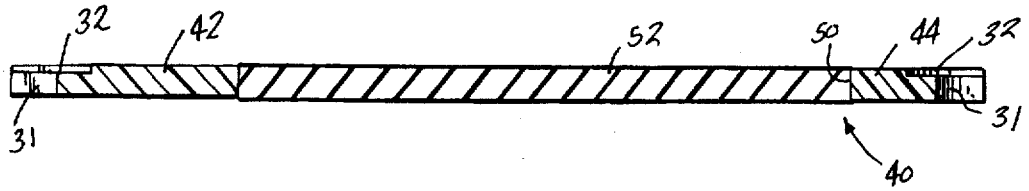
FIG. 4 is a cross-sectional view taken along line 4—4 of FIG. 2.

Looking now at FIG. 4, it can be seen that the cavity 50 and the corresponding insert 52 extend all the way through the frame 40. Additional securement of the insert to the frame can be obtained by one or more ribs (not shown) extending into the cavity intermediate upper and lower surfaces of the frame. The rib or ribs would extend into corresponding recesses of the elastomeric insert. Conversely, an annular groove (not shown) in the frame can similarly receive an annular fib (not shown) in the elastomeric insert.

Preferably, the insert 52 is formed to specification first by any conventional means of forming rubber products. The insert 52 is then placed in an appropriate injection mold (not shown), after which polymer, in a liquid state, is injected into the mold and around the elastomeric insert. The temperature of a hard polymer such as urethane during injection is about 340° F. which is not hot enough to alter the chemical state of the elastomeric insert. Nevertheless, the high temperature of the liquid polymer aids the bonding of the polymer to the elastomeric insert.

It will be apparent that when installed as shown in FIG. 1, the tie pad 30 is positioned so that the outboard edge of the supporting flange 28 will bear against the outboard side 42 of the frame 40 while the breadth of the flange 28 bears against the elastomeric insert 52. The insert 52 is thus compressed within the cavity 50 and against the rail seat area 18 of the tie 12. This compression aids in preventing the frame 40 from sliding on the tie 12, and further seals the rail seat area 18 beneath the tie pad from any incursion of moisture.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure without departing from the spirit of the invention.

We claim:

1. A railroad tie pad adapted to support a railway rail having a base width and base edges on a railroad tie, the tie pad comprising:

a hard non-metallic frame defining a central cavity and having a pair of opposed sides disposed generally parallel to the base edges but close enough to each other so as to support the base edges when the rail is supported by the pad, and an elastomeric insert, secured to the frame and filling the central cavity, wherein the width of the elastomeric insert is less than the base width whereby when the tie pad rests upon the tie and the rail is mounted upon the tie pad, forces acting laterally on the rail will urge the rail to bear primarily against the frame and not the insert.

2. A railroad tie pad according to claim 1 wherein the nonmetallic polymer is urethane.

3. A railroad tie pad according to claim 1 wherein the elastomeric insert is natural rubber.

4. A railroad tie pad according to claim 1 wherein the elastomeric insert is a blend of natural rubber and SBR.

5. A railroad tie pad according to claim 1 wherein the elastomeric insert is bonded to the frame.

6. A railroad tie pad according to claim 1 wherein the elastomeric insert is mechanically secured to the frame.

7. A railroad tie pad according to claim 1 wherein one side of said pair of opposed sides being wider than the other side of said pair.

8. A railroad tie pad according to claim 7 wherein one of said longitudinal base edges is inboard and another of said longitudinal base edges is outboard relative to a train moving on the rail, the wider side of the frame being adapted to support the outboard base edge of the rail.

9. A railroad tie pad according to claim 1 wherein the elastomeric insert has tabs and the frame has recesses adapted to receive the tabs whereby the elastomeric insert is mechanically secured to the frame.

10. A railroad tie pad according to claim 1 wherein the elastomeric insert is slightly thicker than the frame.

11. A railroad tie pad according to claim 10 wherein the nonmetallic polymer is urethane.

12. A railroad tie pad according to claim 11 wherein the elastomeric insert is natural rubber.

13. A railroad tie pad according to claim 10 wherein the elastomeric insert is a blend of natural rubber and SBR.

14. A railroad tie pad according to claim 10 wherein the elastomeric insert is bonded to the frame.

15. A railroad tie pad according to claim 10 wherein the elastomeric insert is mechanically secured to the frame.

16. A railroad tie pad according to claim 10 wherein one side of said pair of opposed sides being wider than the other side of said pair.

17. A railroad tie pad according to claim 16 wherein one of said longitudinal base edges is inboard and another of said longitudinal base edges is outboard relative to a train moving on the rail, the wider side of the frame being adapted to support the outboard base edge of the rail.

* * * * *